US006599159B1

(12) United States Patent
Hedlund et al.

(10) Patent No.: US 6,599,159 B1
(45) Date of Patent: Jul. 29, 2003

(54) DRIVE MEANS A BOAT

(76) Inventors: Benny Hedlund, Hönö (SE); Kare Jonsson, Trollhättan (SE)

( * ) Notice: Subject to any disclaimer, the term of this patent is extended or adjusted under 35 U.S.C. 154(b) by 0 days.

(21) Appl. No.: 09/936,364

(22) PCT Filed: Mar. 16, 2000

(86) PCT No.: PCT/SE00/00516

§ 371 (c)(1),
(2), (4) Date: Dec. 3, 2001

(87) PCT Pub. No.: WO00/58148

PCT Pub. Date: Oct. 5, 2000

(30) Foreign Application Priority Data

Mar. 16, 1999 (SE) ..... 9900939

(51) Int. Cl.[7] ..... B63H 5/10
(52) U.S. Cl. ..... 440/81
(58) Field of Search ..... 440/81, 80, 49

(56) References Cited

U.S. PATENT DOCUMENTS 1,910,561 A * 5/1933 Pierce ..... 440/81
2,372,247 A * 3/1945 Billing ..... 440/81
2,987,031 A 6/1961 Odden ..... 440/81
5,232,386 A * 8/1993 Gifford ..... 440/80
5,632,658 A * 5/1997 Chen et al. ..... 440/49

FOREIGN PATENT DOCUMENTS

| | | |
|---|---|---|
| DE | 35 19 599 | 1/1986 |
| DE | 196 40 481 | 5/1998 |
| EP | 0 215 758 | 3/1987 |
| EP | 0 269 272 | 6/1988 |

* cited by examiner

*Primary Examiner*—S. Joseph Morano
*Assistant Examiner*—Lars A. Olson

(57) ABSTRACT

A boat propeller drive with an underwater housing which is connected in a fixed manner to a boat hull and has tractor propellers which are arranged on that side of the housing facing ahead and the blade areas of which are adapted to one another in such a manner that, at least under certain operating conditions, the aft propeller works in a cavity-generating manner whereas the fore propeller works in a cavitation-free manner.

12 Claims, 4 Drawing Sheets

DRIVE MEANS A BOAT

BACKGROUND OF THE INVENTION

The present invention relates to a drive assembly in a boat, comprising a propeller drive which is arranged in a fixed manner on the outside of a boat hull and has an at least essentially vertical drive shaft which, via an angle gear enclosed in an underwater housing, drives in a counter-rotating manner a pair of at least essentially horizontal propeller shafts each with their own propeller, and a drive unit which is arranged on the inside of the hull and to which the vertical drive shaft is drivably connected.

It is a known fact that, in fast motor boats, it is possible to achieve considerably higher overall efficiency with an outboard drive with twin counter-rotating propellers coupled to an inboard engine than with an inboard engine coupled to a straight shaft with a single propeller. Until now, outboard drives in fast boats have with few exceptions been of the type which is suspended steerably as well as trimmably and tiltably in the transom stern of the boat. Such an exception is disclosed and described in SE 8305066-6, where a special embodiment of a drive with a pusher propeller and a tractor propeller is installed in a fixed manner and projects down from the bottom of the hull. The advantage of being able to trim the drive at different angles in relation to the transom stern of the boat is that the drive angle can be adapted to the position of the boat in the water, which depends on loading, speed and weather conditions, so that optimum propulsion can be achieved under different operating conditions. The advantages of being able to trim the drive are most apparent in smaller and medium-sized fast-moving boats up to about 40 feet. The larger and heavier the boat is, the less its position in the water is affected by said factors and the smaller the need to be able to trim the drive. At the same time, the cost of the drive increases considerably, the greater the power that it is to transmit. For these reasons inter alia, outboard drives are seldom used in boats in the size class over 40 feet, but in this case the engines drive straight propeller shafts with a single propeller via inboard-mounted reversing gears.

SUMMARY OF THE INVENTION

The object of the present invention is generally to provide a drive assembly of the type referred to in the introduction, which is primarily but not exclusively intended to replace a conventional inboard installation with reversing gear and a straight shaft in larger boats, and in this connection, compared with the inboard installation, to bring about not only higher overall efficiency and better performance but also simplified installation and lower installation weight.

According to the invention, this is achieved primarily by virtue of the fact that the propellers are tractor propellers and that the blade areas of the propellers are adapted to one another in such a manner that, at least under certain operating conditions, the aft propeller works in a cavity-generating manner whereas the fore propeller works in a cavitation-free manner.

It is previously known to use a propeller combination of a fore and an aft propeller together with steerable outboard drives, in which combination, at least at higher speeds, the aft propeller works in a cavity-generating manner whereas the fore propeller works in a cavitation-free manner. In this way, it is possible to reduce the grip of the propellers in the water slightly during turning, so that a certain sideways sliding occurs and uneven movement is avoided, which is essential as far as boats with a Froude number close on 5 are concerned. However, it has been found that such a propeller combination can lead to various advantages even in boats with a lower Froude number and with fixed drives with tractor propellers. When the aft propeller generates cavities, the resistance in the water from the underwater housing lying behind is reduced. Moreover, cavitation damage to the underwater housing is prevented when the aft propeller generates cavities. A further advantage is that the cavitation threshold is raised in the speed range, which means that the upper speed limit of the propeller can be raised or alternatively that the blade area can be reduced.

According to a development of the drive according to the invention, another possibility afforded by a drive with tractor propellers is the positioning of an exhaust discharge outlet in the aft side of the underwater housing, which means that it is possible inter alia to utilize the ejector effect which the water flowing past exerts on the exhaust gases streaming out in the same manner as when the exhaust gases are conveyed out through the propeller hubs. When the exhaust gases are conveyed out in the rear edge of the underwater housing instead of through the hubs, the hub diameter and thus the overall propeller diameter can be reduced, which is advantageous in a number of respects. On the one hand, the mass and the mass forces are reduced and, on the other hand, the space requirement under the bottom of the hull is reduced, which means that the drive shaft housing can be designed so as to be shorter and consequently lighter than if propellers with an exhaust discharge outlet in the hubs were to be used.

BRIEF DESCRIPTION OF THE DRAWING

The invention is described in greater detail with reference to exemplary embodiments shown in the appended drawings, in which.

DETAILED DESCRIPTION OF THE PREFERRED EMBODIMENTS

Figure 1:
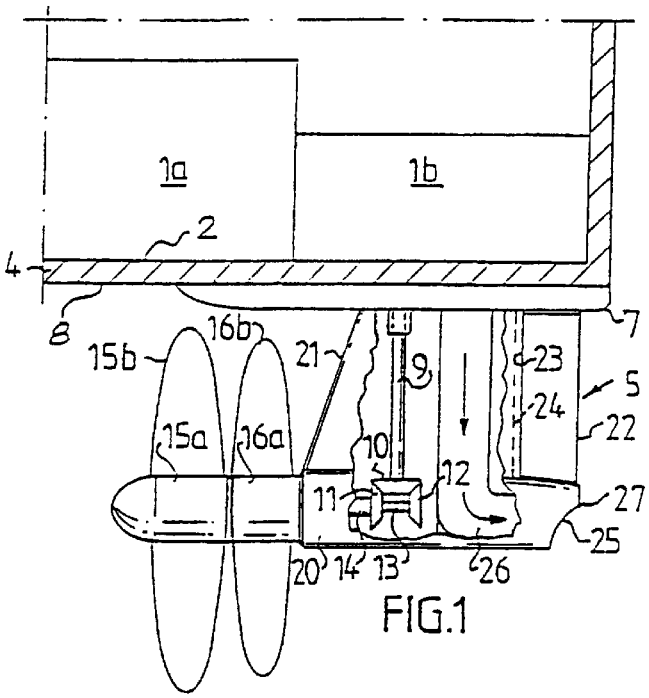
FIG. 1 shows a diagrammatic partly cut-away side view of an embodiment of a drive assembly according to the invention.

In FIG. 1, reference number 1 designates generally a drive unit consisting of an engine 1*a* and a reversing gear mechanism 1*b* which are fixed to an inner surface 2 on the bottom 4 of a boat hull. An underwater housing 5 has a fastening plate 7 which is fastened to an outer surface 8 on the bottom 4. The engine 1*a* drives, via an angle gear in the reversing gear 1*b*, an output shaft 9 which in turn drives, via an angle gear comprising conical gearwheels 10, 11 and 12, a pair of propeller shafts 13 and 14, of which the shaft 14 is a hollow shaft, through which the shaft 13 extends. The shaft 13 bears a propeller 15 with a hub 15*a* and blades 15*b*, and the shaft 14 bears a propeller 16 with a hub 16*a* and blades 16*b*.

Figure 3:
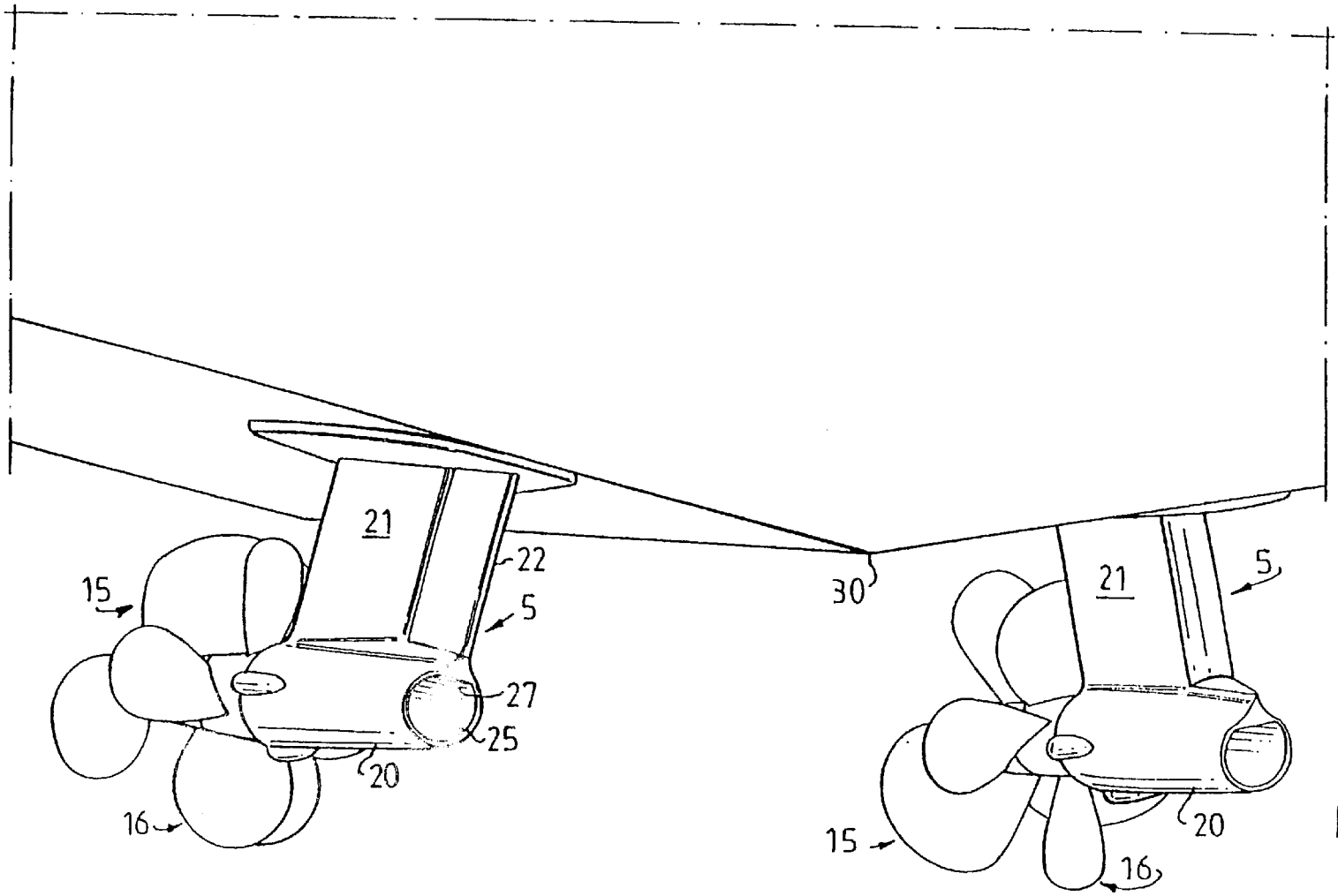
FIG. 3 shows a perspective view of a drive installation comprising two drive assemblies according to FIGS. 1 and 2.

The propeller shafts 13 and 14 are mounted in a torpedo-like part 20 of the underwater housing 5. The housing part 21 between the torpedo 20 and the fastening plate 7 has a wing-like profile with slightly domed side surfaces on both sides of a vertical plane of symmetry. On the aft side of the housing part 21, a rudder flap 22 is mounted for pivoting about a vertical pivoting axis. The front end portion 23 of the rudder flap 22 has a semi-circular cross section and projects into a semi-circular channel 24, as shown most clearly in FIG. 3, where the starboard drive assembly is shown with the rudder blade removed. The side surfaces of the rudder flap lie, at the front edge, in the same plane as the rear edge of the side surfaces of the housing part 21, so that a smooth transition is obtained between the housing part 21 and the rudder flap 22. Together, these two extend over the entire length of the torpedo 20.

At its aft end, the torpedo 20 has a discharge opening 25, in which an exhaust pipe 26 opens, which runs from the engine 1*a* and through the underwater housing 5. As a result, the propellers will work in completely undisturbed water, on the one hand on account of their being positioned in front of the underwater housing and on the other hand on account of the positioning of the exhaust discharge outlet, which moreover, on account of the ejector effect which arises during motion, contributes to minimum exhaust back-pressure. As can be seen from the figures, the torpedo is at its rear edge designed with a screen 27 towards the rudder flap 22 in order to screen the rudder blade from the exhaust gas flow. By virtue of the fact that the exhaust gases are conveyed out through the underwater housing and not through the propeller hubs 15*a* and 16*a*, the diameter of the hubs and thus the diameter of the propeller as a whole can be reduced. In steerable outboard drives with pusher propellers, the maximum diameter of the hubs is normally the same as the maximum diameter of the adjacent part of the underwater housing, whereas the maximum hub diameter of the propellers 15 and 16 shown in FIGS. 2–5 is roughly 60–65% of the maximum diameter of the torpedo 20 in the portion adjacent to the propellers. As the propellers require a certain minimum distance from the surface of the bottom of the boat above, the length of the underwater housing in the vertical direction is also affected by the propeller diameter, which means that the smaller the propeller diameter is, the shorter the underwater housing needs to be in the vertical direction.

Figure 2:
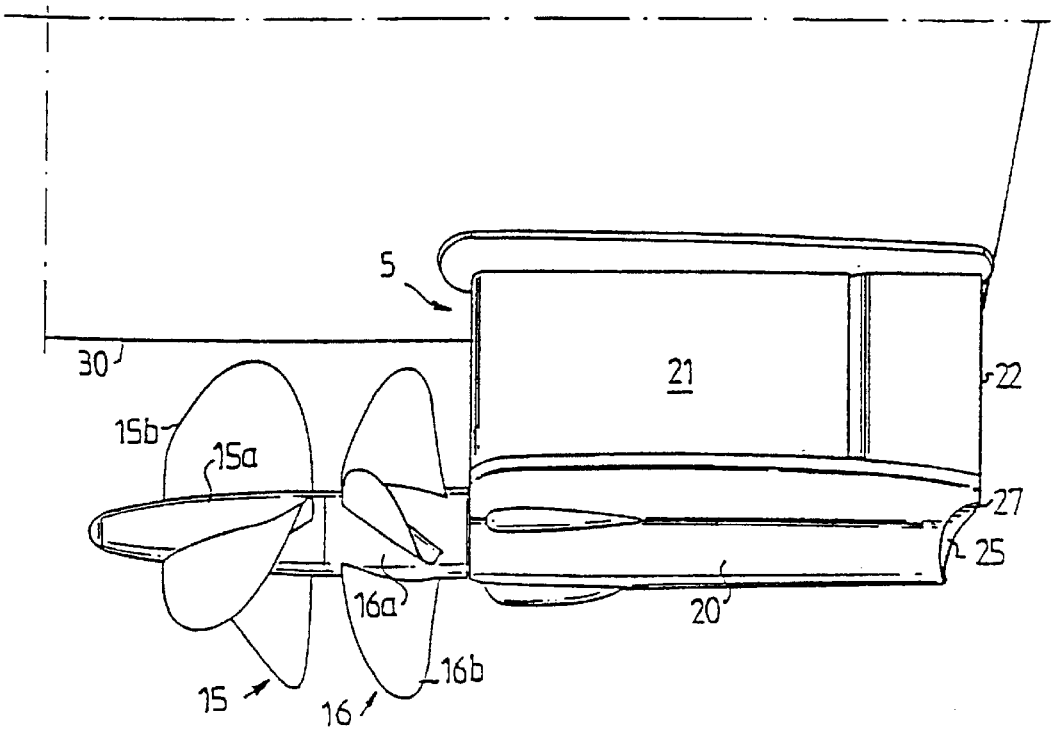
FIG. 2 shows a plain side view of the drive assembly in FIG. 1.

FIG. 2 shows a propeller drive of the type described in connection with FIG. 1, that is to say a drive with an underwater housing 5 which is fixed directly to the bottom surface of the boat hull by its fastening plate 7. The drive has two propellers 15 and 16, of which the fore propeller has three blades whereas the aft propeller has four blades, which is known per se in steerable outboard drives. In a preferred embodiment, moreover, the blade areas of the propellers are adapted to one another in such a manner that, within a predetermined upper speed range, the aft propeller works in a cavity-generating manner whereas the fore propeller works in a non-cavity-generating manner.

The propeller drive in FIG. 2 is mounted on one side of and at a distance from the centre line 30 of the bottom. A corresponding propeller drive is mounted on the other side of the centre line, as shown in greater detail in FIG. 3. As mentioned above, the rudder flap of the right-hand drive has been removed in order to illustrate the design of the wing-like part 21 of the underwater housing 5. With twin-mounted drives, means (not shown) can advantageously be arranged, which make it possible to disconnect the normal synchronous operation of the rudder blades and instead steer the rudder blades in a mirror-inverted manner, that is to say in such a manner that a given deflection of one rudder to, for example, port leads to a corresponding deflection of the other to starboard. In this way, the steering deflections cancel each other out and the rudders instead function as brake flaps without any steering effect.

Figure 4:
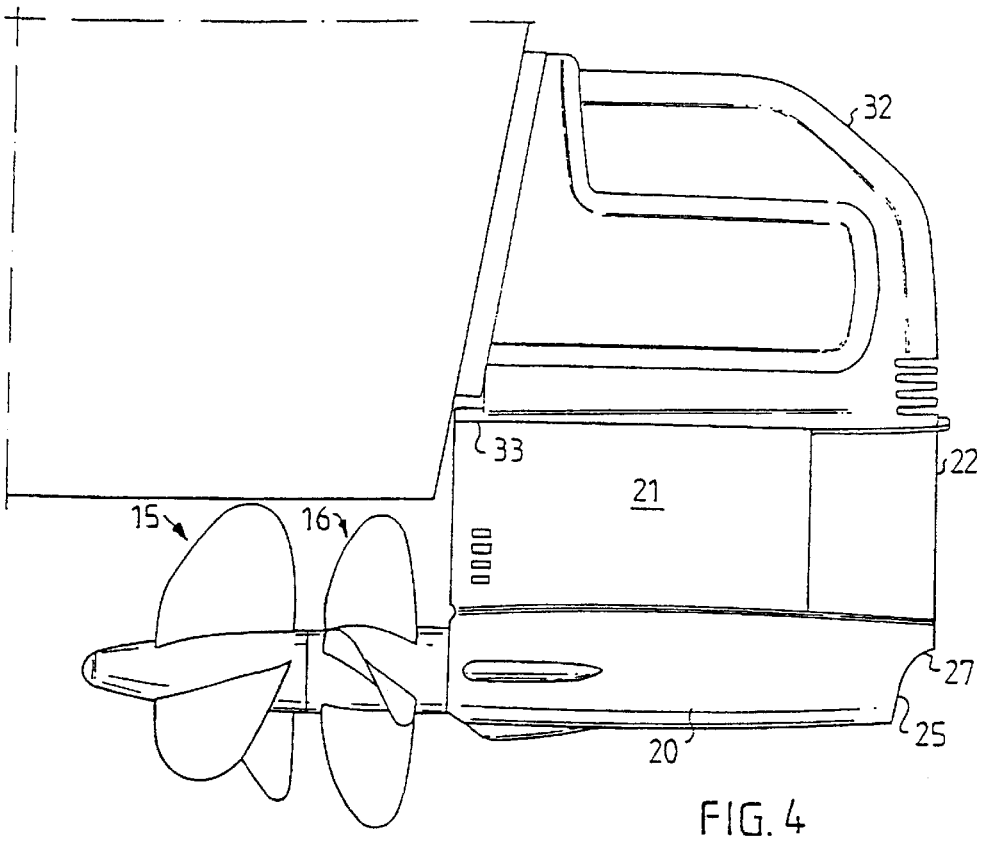
FIG. 4 shows a side view of a second embodiment of a drive assembly according to the invention.
Figure 5:
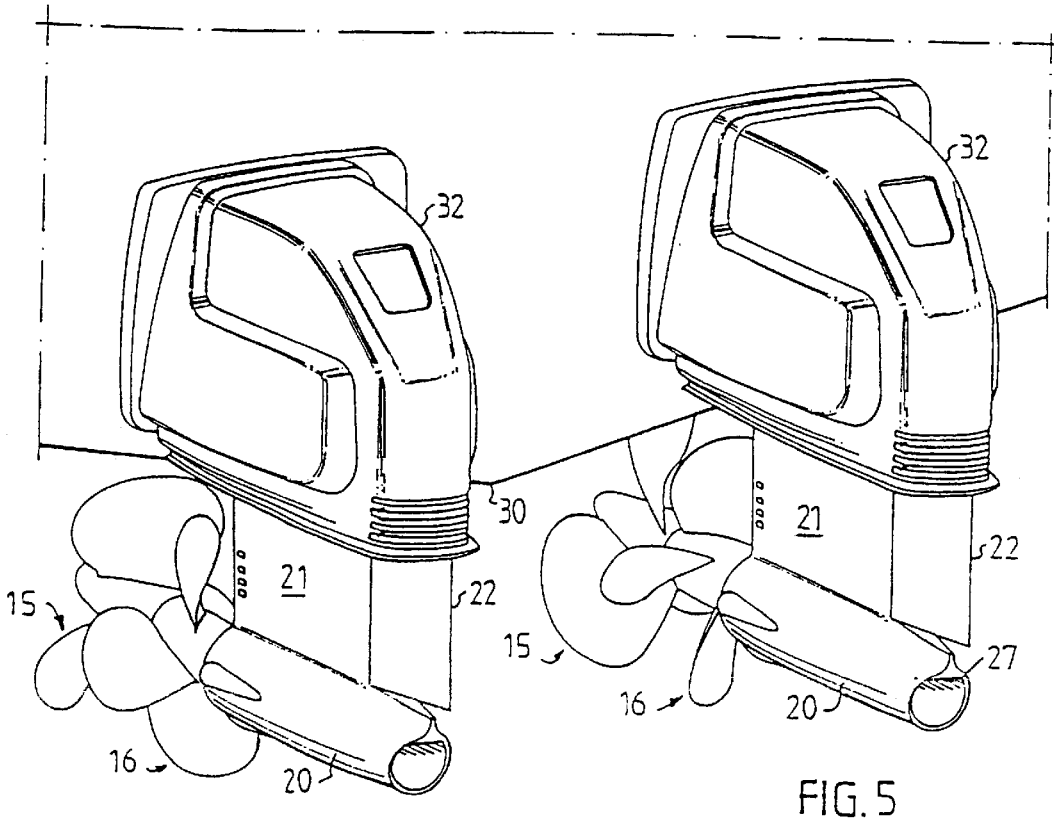
FIG. 5 shows a perspective view of a drive installation comprising two drive assemblies according to FIG. 4.

FIG. 4 shows an embodiment of a propeller drive according to the invention, which differs from that described above in that the underwater housing 5 is connected to a housing 32 which is mounted against the transom stern 31 of the hull and contains an angle gear and a reversing gear mechanism with an output shaft connected to the shaft 9 (FIG. 1). In the transition between the housing 32 and the underwater housing 5, the latter is designed with a cavitation plate 33 which extends up to the transom stern 31. The front edge of the cavitation plate 33 is sealed against the surface of the transom stern, so that the cavitation plate 33 forms an extension of the bottom of the boat. Like the drive in FIGS. 1–3, the drive in FIG. 4 has a three-bladed fore propeller and a four-bladed aft propeller which is preferably, within a given upper speed range, a cavity-generating propeller. FIG. 5 shows a boat hull with two drives of the type shown in FIG. 4 mounted on the transom stern at an equal distance from the centre line 30.

Figure 6:
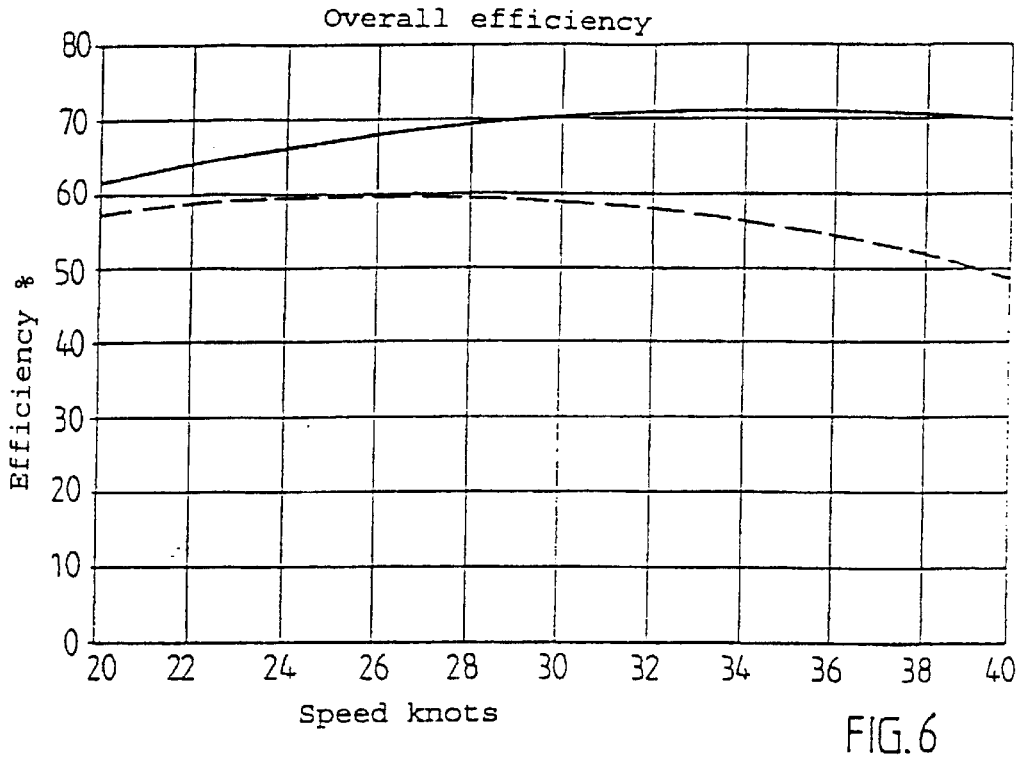
FIG. 6 shows a diagram of the overall efficiency of a drive assembly according to the invention compared with a conventional inboard installation.
Figure 7:
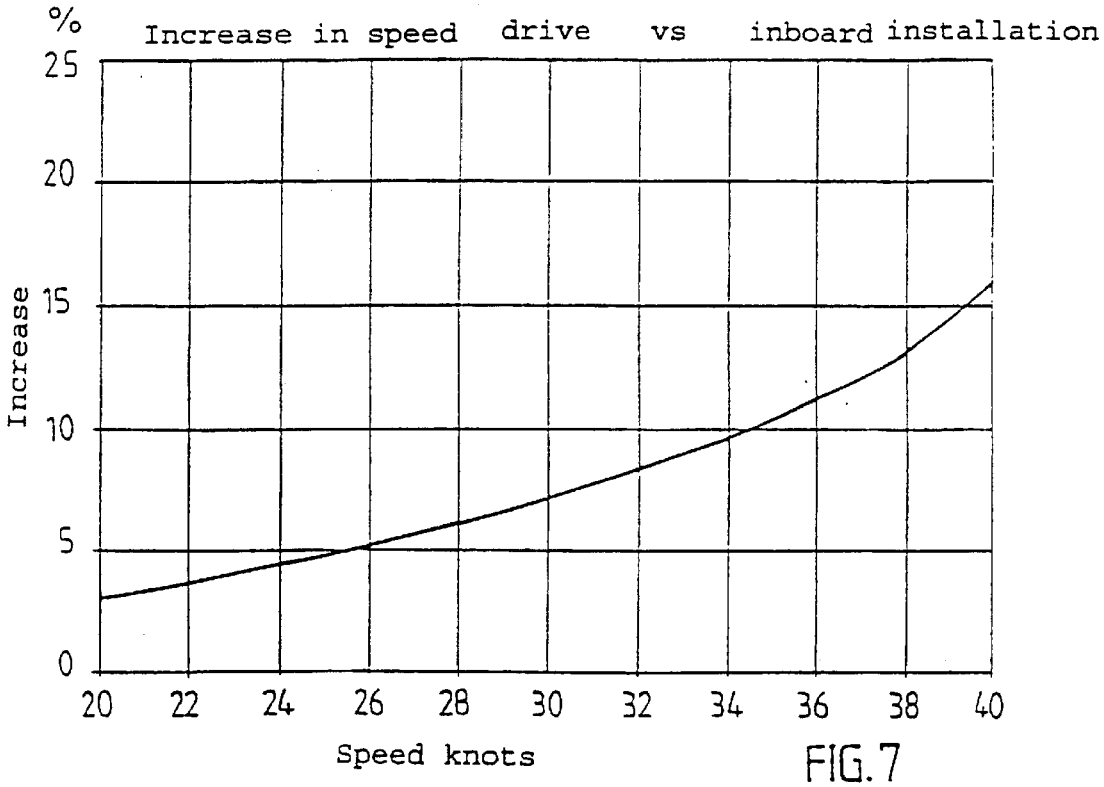
FIG. 7 shows a diagram illustrating the increase in speed of a boat with a drive assembly according to the invention in relation to a boat with a conventional inboard installation.

The diagram in FIG. 6 illustrates the overall efficiency as a function of the speed of the boat for one and the same boat type with on the one hand a conventional inboard installation, that is to say straight shafts and a single propeller (broken line), and on the other hand the drive assemblies according to the invention described above (solid line). As can be seen from the diagram, the difference at, for example, 38 knots is as much as 20 percentage units, in other words an increase in overall efficiency of no less than roughly 40% is obtained with the installation according to the invention compared with a conventional inboard installation. The diagram in FIG. 7 illustrates in a corresponding manner the increase in speed of a boat with a drive assembly according to the invention in relation to the same boat with a conventional inboard installation. It can be seen from the diagram, for example, that if the top speed of a boat with a drive assembly according to the invention is 40 knots when equipped with a given engine, the top speed of the same boat and engine with a conventional inboard installation is roughly 35 knots.

What is claimed is:

1. Drive assembly in a boat, comprising:

a propeller drive which is arranged in a fixed manner on the outside of a boat hull and has an at least essentially vertical shaft which, via an angle gear enclosed in an underwater housing, drives in a counter-rotating manner a pair of at least essentially horizontal propeller shafts each with their own propeller, and a drive unit which is arranged on the inside of the hull and to which the vertical shaft is drivably connected, wherein the propellers are tractor propellers, and wherein the blade areas of the propellers are adapted to one another in such a manner that, at least within a predetermined upper speed range, the aft propeller works in a cavity-generating manner and the fore propeller works in a cavitation-free manner.

2. Drive assembly according to claim 1, characterized in that a rudder blade is mounted in the underwater housing for pivoting about a vertical axis astern or the propellers.

3. Drive assembly according to claim 2, characterized in that the underwater housing has an upper portion with a wing profile, and in that the rudder blade forms a wing-flap-like extension astern of the portion with the wing profile.

4. Drive assembly according to claim 3, characterized in that the underwater housing has a lower torpedo-like portion which is connected to the lower edge of the portion with the wing profile and in which the propeller shafts are mounted.

5. Drive assembly according to claim 4, characterized in that the length of the torpedo-like portion is at least approximately equal to the sum of the lengths of the portion with the wing profile and the rudder blade.

6. Drive assembly according to claim 4, characterized in that the torpedo-like portion has in its end portion facing astern an exhaust discharge outlet from an internal combustion engine which drives said drive shaft.

7. Drive assembly according to claim 6, characterized in that that end portion of the torpedo-like portion facing astern is designed in such a manner that a screen is formed between the aft lower end portion of the rudder blade and an exhaust discharge opening.

8. Drive assembly according to claim 4, wherein the propellers have hubs that have a maximum diameter smaller than a maximum diameter of the torpedo-like portion.

9. Drive assembly according to claim 8, characterized in that the maximum hub diameter of the propellers is roughly 20% of the propeller diameter.

10. Drive assembly according to claim 3, characterized in that that portion of the underwater housing with the wing profile has means for fixing the portion to the underside of the bottom of the hull.

11. Drive assembly according to claim 3, characterized in that the underwater housing is connected to a drive housing which is fixed to a transom stern of the hull, and in that a cavitation plate is arranged in the transition between the drive housing and the underwater housing, which cavitation plate has a front end edge which bears against a surface on the transom stern.

12. Drive installation in a boat, comprising two drive assemblies according to claim 1 arranged next to one another, characterized in that the rudder blades are individually steerable in order to allow rudder deflection in opposite directions.

* * * * *

UNITED STATES PATENT AND TRADEMARK OFFICE

CERTIFICATE OF CORRECTION

PATENT NO. : 6,599,159 B1
DATED : July 29, 2003
INVENTOR(S) : Hedlund et al.

It is certified that error appears in the above-identified patent and that said Letters Patent is hereby corrected as shown below:

Title page,
Item [54], "DRIVE MEANS A BOAT" should be -- DRIVE MEANS IN A BOAT --.

Signed and Sealed this

Seventh Day of October, 2003

JAMES E. ROGAN
*Director of the United States Patent and Trademark Office*